US006199632B1

(12) United States Patent
Shy

(10) Patent No.: US 6,199,632 B1
(45) Date of Patent: Mar. 13, 2001

(54) SELECTIVELY LOCKING LOCATOR

(75) Inventor: Perry C. Shy, Southlake, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/198,028

(22) Filed: Nov. 23, 1998

(51) Int. Cl.[7] ..... E21B 17/02

(52) U.S. Cl. ..... 166/242.6; 166/243; 166/212

(58) Field of Search ..... 166/242.6, 243, 166/212, 213, 214, 282

(56) References Cited

U.S. PATENT DOCUMENTS

| | | | | |
|---|---|---|---|---|
| 4,441,559 | * | 4/1984 | Evans et al. | 166/212 |
| 4,479,539 | * | 10/1984 | Tamplen et al. | 166/212 |
| 4,745,974 | * | 5/1988 | Higgins | 166/217 |
| 5,070,941 | | 12/1991 | Kilgore | 166/98 |
| 5,119,875 | * | 6/1992 | Richard | 166/214 |
| 5,398,764 | * | 3/1995 | Collins | 166/212 |
| 5,579,829 | * | 12/1996 | Comeau et al. | 166/214 |
| 5,636,690 | * | 6/1997 | Garay | 166/243 |
| 5,803,175 | * | 9/1998 | Myers, Jr. et al. | 166/242.6 |

FOREIGN PATENT DOCUMENTS

WO 91/05935 * 5/1991 (WO) ..... 166/212

* cited by examiner

*Primary Examiner*—Thomas B. Will
*Assistant Examiner*—Meredith C. Petravick
(74) *Attorney, Agent, or Firm*—Paul I. Herman; Lawrence R. Youst

(57) ABSTRACT

A locator device (50) that is selectively lockable within a nipple profile (40) disposed within a wellbore (32). The locator device (50) comprises a locator key (106) disposed between a housing (104) and a mandrel (102) that is radially extendable through a window (108) of the housing (104). The locator key (106) has an engageable position and a retracted position with respect to nipple profile (40). A support ring (110) is disposed between the housing (104) and the mandrel (102) that maintains the locator key (106) in the engageable position until the support ring (110) is axially displaced relative to the mandrel (102). A engagement mechanism (116, 118) is disposed within a radial bore (114) of the mandrel (102) that is selectively engageable with the support ring (110) in response to a differential pressure such that axial force from the support ring (110) is transferred to the mandrel (102), thereby preventing axial displacement of the support ring (110) relative to the mandrel (102) and preventing the passage of the locator device (50) in a first direction relative to the nipple profile (40).

33 Claims, 7 Drawing Sheets

SELECTIVELY LOCKING LOCATOR

TECHNICAL FIELD OF THE INVENTION

This invention relates, in general, to tools used during the completion and operation of a subterranean wellbore and, in particular to, a selectively locking locator used to selectively prevent the passage of the locator through a landing nipple once the locator is locked in place within the subterranean wellbore.

BACKGROUND OF THE INVENTION

Without limiting the scope of the present invention, its background will be described with reference to perforating and fracturing a subterranean formation, as an example.

Heretofore in this field, a potentially productive geological formation beneath the earth's surface which contains a sufficient volume of valuable fluids, such as hydrocarbons, may have a very low permeability. As the valuable fluids are contained within pores in the potentially productive subterranean formation, if the pores are not interconnected, the fluids cannot move about and, thus, cannot be brought to the earth's surface without a structural modification of the production zone.

In such a formation having a very low permeability, but a sufficient quantity of valuable fluids in its pores, it becomes necessary to artificially increase the formation's permeability. This is typically accomplished by fracturing the formation, a practice that is well known in the art. Basically, fracturing is achieved by applying sufficient pressure to the formation to cause it to crack or fracture. The desired result of this process is that the cracks interconnect the formation's pores and allow the valuable fluids to be brought out of the formation and to the surface.

In conventional fracturing, the general sequence of steps needed to stimulate a production zone through which a wellbore extends is as follows. First, a plug is set in the well casing at a predetermined depth in the well, proximate the subterranean production zone requiring stimulation. Next, a perforating trip is made by lowering a perforation assembly into the wellbore on a lower end portion of a work string. The gun assembly is then detonated to create a spaced series of perforations extending outwardly through the casing, the cement and into the production zone. The discharged gun assembly is then pulled up with the work string to complete the perforating trip.

Next, the spent gun assembly may be replaced on the work string with a proppant discharge member having a spaced series of discharge openings formed therein. The proppant discharge member is then lowered into the wellbore such that the discharge openings are, at least theoretically, aligned with the gun-created perforations. Proppant slurry is then pumped down the work string so that proppant slurry is discharged through the discharge member openings and then flowed outwardly through the casing and cement perforations into the corresponding perforations in the surrounding production zone. The work string is then pulled out again to complete the stimulation trip and ready the casing for the installation therein of production tubing and its associated production packer structures.

Alternatively, attempts have been made to design a single trip apparatus and method to perforate and stimulate a hydrocarbon formation. In this case, the work string carries a drop-off type perforating gun and a locator installed thereon above the perforating gun. The gun is operatively positioned within the casing by lowering the locator through an internal profile within the nipple to a location below the nipple. The work string is then pulled upwardly to engage the key of the locator in the nipple profile. Once in place, the guns may be fired to create a spaced series of perforations extending outwardly through the work string, the casing, the cement and into the production zone. The gun is now dropped to a location below the perforations. The proppant slurry is then pumped down the work string. The proppant slurry is discharged through the openings in the work string, the casing and the cement into the corresponding perforations in the surrounding production zone.

It has been found, however, the even when the proppant slurry is pumped down the work string on the same trip as the perforation, the alignment, both axial and circumferential, of the gun-created perforations in the work string and in the casing is not maintained unless a substantial overpull tension force is exerted on the portion of the work string above the locator and maintained during the firing of the gun. The desired overpull force, however, may sheer the sheer pins in the locator causing disengagement of the locator from the nipple profile.

A need has therefore arisen for a locator device that may be used during a single trip perforating and fracturing operation. A need has also arisen for such a locating device that may be locked into a nipple profile and support substantial tensile load within the work string without sheering internal sheer pins or releasing from the nipple profile. A need has further arisen for such a locating device that is simple to disengage from the nipple profile once the perforating and fracturing operation has been completed.

SUMMARY OF THE INVENTION

The present invention disclosed herein comprises a locator device that may be used during a variety of downhole operation. The locating device of the present invention may be locked into a nipple profile and support a tensile force in the work string without sheering internal sheer pins or releasing from the nipple profile. The locating device of the present invention is also simple to disengage from the nipple profile once the wellbore operation has been completed.

The locator device of the present invention comprises a mandrel having one or more radial bores through the sidewall thereof. A housing is partially disposed exteriorily around the mandrel. A set of locator keys is disposed between the housing and the mandrel. The locator keys are radially extendable through a window in the housing. The locator keys have a first position wherein the locator keys are engageable with the landing nipple and a second position wherein the locator keys are retracted from the nipple profile. A support ring is disposed between the housing and the mandrel. The support ring prevents movement of the locator key from the first position to the second position until the support ring is axially displaced relative to the mandrel. Disposed within each of the radial bores are pistons that are selectively engagable with the support ring in response to a differential pressure between the interior and the exterior of the locator device. When the pistons are operably engaged with the support ring, axial displacement of the support ring relative to the mandrel is prevented as is retraction of the locator keys from the nipple profile. As such, upward passage of the locator device through the nipple profile is also prevented.

The locator device may include one or more sheerable members extending between the mandrel and the support ring that sheer in response to a predetermined axial force between the support ring and the mandrel. The sheerable members will not sheer, however, when the pistons are operably engaged with the support ring as the axial force from the support ring is transferred to the mandrel through the piston.

A c-ring may be disposed between the pistons and the support ring. The c-ring may include a plurality of teeth that engage a plurality of teeth on the support ring to selectively prevent axial displacement of the support ring relative to the mandrel. The c-ring radially biases the pistons to disengage the pistons from the support ring when the differential pressure between the interior and exterior of the locator device is reduced below a predetermined level. Alternatively, a differential pressure having a gradient opposite that of the prior differential pressure may be acted on the pistons to disengage the pistons from the support ring. For example, if the differential pressure used to engage the pistons requires a higher pressure on the interior of the locator device than on the exterior of the locator device, the differential pressure used to disengage the pistons will require a higher pressure on the exterior of the locator device than the interior of the locator device.

Once the pistons has been disengaged from the support ring, the axial force between the support ring and the mandrel caused by upward pulling on the locator device will sheer the sheerable members. A shoulder on the window of the housing then engages the locator key as the support ring is axially displaced relative to the mandrel such that the locator key disengages from the nipple profile. After the locator key has disengaged from the nipple profile, upward passage of the locator device through the nipple profile is allowed.

Viewed more broadly, the present invention may be applied to a variety of downhole tools when it is desirable to selectively prevent the relative axial movement between first and second tubular members. The second tubular member, whether located on the interior or the exterior of the first tubular member, has one or more radial bores in the sidewall thereof wherein pistons are disposed. The pistons selectively engage the first tubular member in response to a differential pressure between the interior and the exterior of the tubular members. Axial movement of the tubular members relative to one another is selectively prevented while the pistons are engaged.

When the second tubular member is disposed within the interior of the first tubular member, the piston is shifted radially outwardly in response to the differential pressure. When the second tubular member is disposed exteriorily about the tubular member, the piston is shifted radially inwardly in response to the differential pressure.

A c-ring may be disposed between the piston and the first tubular member. When the second tubular member is disposed within the interior of the first tubular member, the c-ring radially inwardly biases the piston to disengage the piston from the first tubular member. When the second tubular member is disposed exteriorily about the first tubular member, the c-ring radially outwardly biases the piston to disengage the piston from the first tubular member.

Alternatively, the piston may be disengaged from the first tubular member in response to a differential pressure having a gradient opposite to that of the differential pressure that engages the pistons with the first tubular number. When the second tubular member is disposed within the interior of the first tubular member, this differential pressure radially inwardly shifts the piston to disengage the piston from the first tubular member. When the second tubular member is disposed exteriorily about the first tubular member, this differential pressure radially outwardly shifts the piston to disengage the piston from the first tubular member.

In operation, the present invention may, for example, comprise selectively preventing passage of a locator device through a nipple profile once the locator device is locked within the nipple profile by engaging a set of locator keys with the nipple profile, providing a differential pressure to the locator device to act on the pistons disposed within radial bores in the sidewall of the mandrel, radially shifting the pistons to engage the support ring to transfer axial force from the support ring to the mandrel and to prevent axial displacement of the support ring relative to the mandrel, thereby preventing retraction of the locator key from the nipple profile and passage of the locator device through the nipple profile.

To disengage the support ring from the mandrel, a c-ring may be used to bias the pistons after the differential pressure within the locator device drops below a predetermined level. Alternatively, differential pressure having a gradient opposite that of the differential pressure that engages the pistons with the support ring may be applied to the locator device to radially shift the pistons to disengage the pistons from the support ring. Once the pistons are disengaged, the locator may be passed through the nipple profile.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention is discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
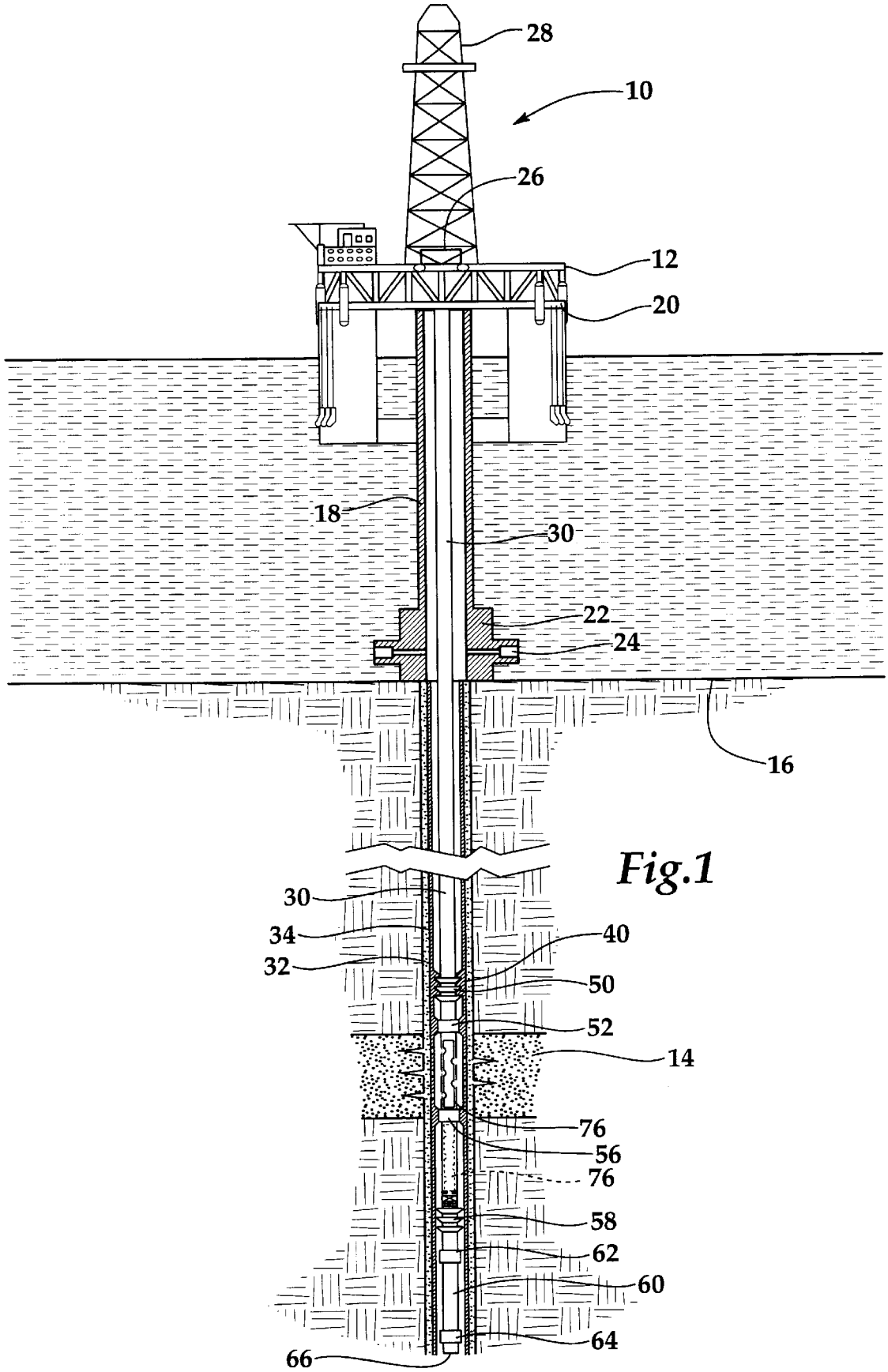
FIG. 1 is schematic illustration of an offshore oil and gas platform operating a selectively locking locator device of the present invention.

Referring to FIG. 1, a single trip perforating and fracturing apparatus including a selectively locking locator in use on an offshore oil and gas platform is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 and for raising and lowering pipe strings such as work sting 30.

Figure 2:
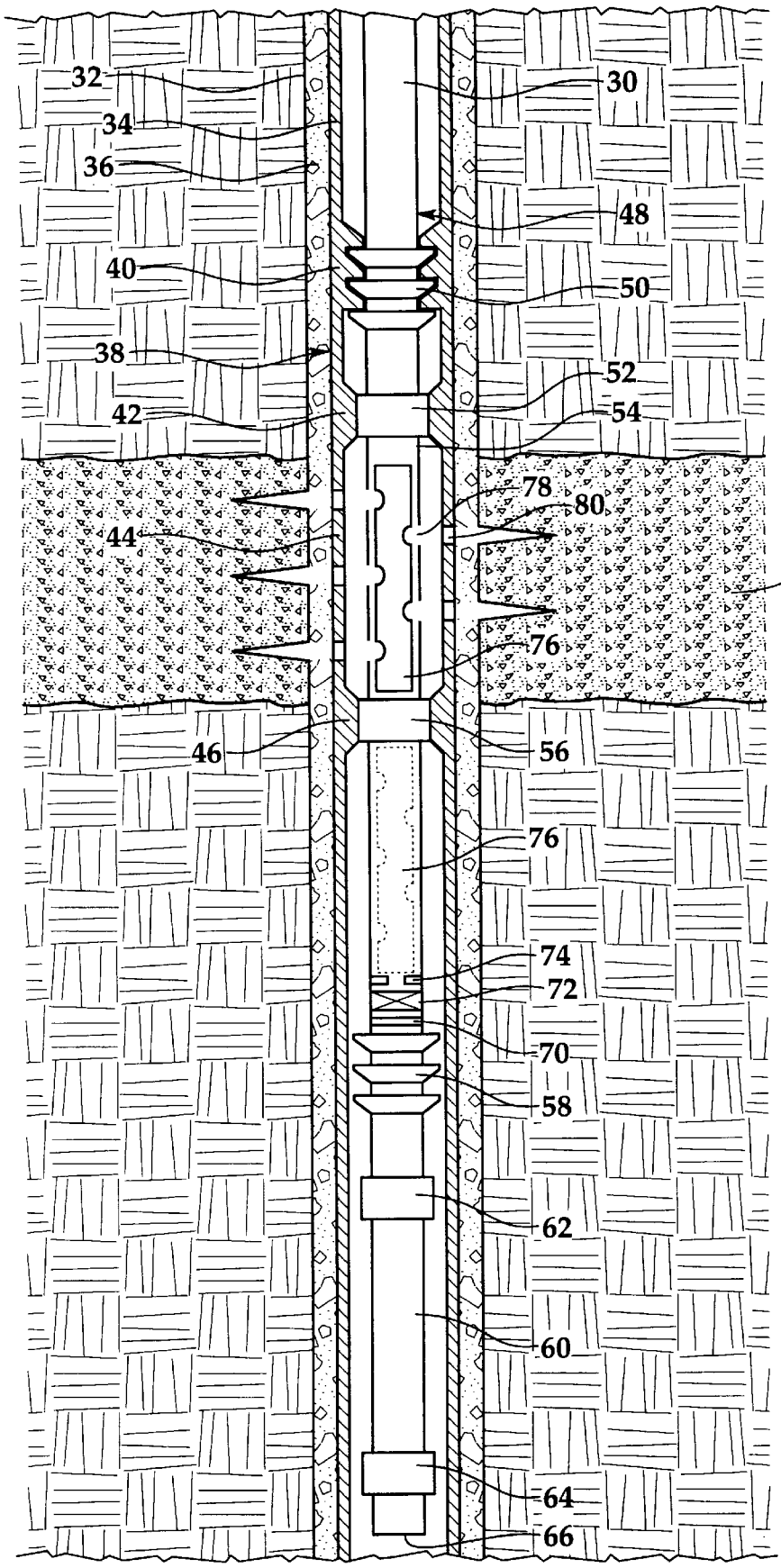
FIG. 2 is schematic illustration of a downhole formation traversed by a wellbore having a selectively locking locator device of the present invention disposed therein.

A wellbore 32 extends through the various earth strata including formation 14. A casing 34 is cemented within wellbore 32 by cement 36. As best seen in FIG. 2, casing 34 includes a nipple 38 that has, from top to bottom along its interior, an annular locator profile 40, a reduced diameter top annular seal surface 42, a radially thinned tubular perforatable side wall area 44 and a reduced diameter bottom annular seal surface 46.

Work string assembly 48 includes a length of work string 30 which is extendable downwardly through casing 34 and its nipple 38. Work string assembly 48 includes, from top to bottom, a selectively locking locator 50 exteriorly mounted on work string 30, upper annular seal structure 52, a longitudinal gun carrying portion 54, a lower annular seal structure 56, a locator 58, a conventional screened tubular sliding side door assembly 60 having upper and lower external annual end seals 62 and 64 and installed in its closed position and an open lower end 66.

The selectively locking locator 50 may be passed downwardly through annular locator profile 40. As will be discussed in detail below, once selectively locking locator 50 is returned upwardly into profile 40, selectively locking locator 50 may be locked within profile 40 to selectively prevent upward passage of locator 50 through profile 40 until such time when it is desired to remove locator 50 from profile 40.

A drop-off type perforating gun 76 is operatively supported within an upper end section of the gun carrying potion 54 of the work string 30. The lower end of gun carrying portion 54 is connected to the portion of the work string 30 therebelow by a suitable releasable connection 70 such as, for example, that typically used in a lock mandrel running tool. Directly above the releasable connection 70, within the work string 30, is a check valve 72 that functions to permit upward fluid flow therethrough and preclude downward fluid flow therethrough. The check valve 72 is directly below an internal no-go structure 74 which, as later described herein, functions to catch perforating gun 76 after it has been fired and drops off its mounting structure within the work string 30.

When it is desired to perforate and stimulate formation 14, work string assembly 48 is lowered through casing 34 until locator 50 is positioned beneath profile 40. Work string assembly 48 is then raised until locator 50 is operatively engaged by profile 40. Work string 30 is then internally pressurized to lock locator 50 within profile 40 to stop further upward movement of the work string assembly 48, as will be more fully described below. Perforating gun 76 is disposed between the upper and lower internal nipple seal areas 42 and 46, with the side of gun 76 facing the perforatable side wall area 44 of the nipple 38. Upper and lower tubing seals 52 and 56 respectively engaging the upper and lower nipple areas 42 and 46, thereby sealing off the interior of the perforatable side wall area 44 from the rest of the interior of work string 30.

Next, the pressure within work string 30 is elevated placing work string 30 in tension, representatively about 250,000 pounds of upward force, which must be supported by locator 50. The gun 76 is then fired to create a spaced series of first perforations 78 in the side wall of the gun carrying portion 54, and a spaced series of second perforations 80 aligned with the first perforations 78 and extending outwardly through the perforatable side wall area 44, the cement 36 and into formation 14.

Alternatively, the first perforations 78 may be preformed in the gun carrying portion 54, before it is lowered into casing 34, and appropriately aligned with the series of detonation portions on the perforating gun 76. When gun 76 is later fired, it fires directly outwardly through the preformed perforations 78, thereby reducing the overall metal wall thickness which gun 76 must perforate.

After the firing thereof, and the resulting circumferentially and axially aligned sets of perforations 78 and 80, the gun 76 is automatically released from its mounting structure within work string 30 and falls downwardly through work string 30 to the dotted line position of the gun 76 in which it is caught within a lower end section of gun carrying portion 54 by the no-go structure 74. In this position, dropped gun 76 is disposed beneath the lowermost aligned perforation set.

After the perforation gun 76 drops, and while still maintaining the tension force on work string 30 above locator 50, formation 14 is stimulated by pumping stimulation fluid, such as a suitable proppant slurry, downwardly through work string 30, outwardly through perforations 78 and into formation 14 through perforations 80 which are aligned with perforations 78 both circumferentially and axially.

At this point it is important to note that the stimulation process for formation 14 has been completed not with the usual plurality of downhole trips, but instead with but a single trip of work string 30. Additionally, during the pumping and work string discharge of the proppant slurry, work string perforations 78 are kept in their initial firing alignment with casing, cement and production perforations 80 as a result of the continuing tension force exerted on work string 30 above locator 50. The high pressure streams of proppant slurry exiting the work string discharge perforations 78 are jetted essentially directly into their corresponding aligned perforations 80, thereby eliminating the conventional tortuous path, and resulting abrasion wear problems, of discharged proppant slurry resulting from misalignments occurring in conventional multi-trip stimulation operations.

The maintenance of the desirable, abrasion reducing alignment between perforations sets 78 and 80 during the proppant slurry phase of the overall stimulation process is facilitated by the previously mentioned tension force maintained during slurry pumping. Such overpull force, coupled with the forcible upward engagement of the locator 50 with the corresponding locator profile 40, automatically builds into work string 30 compensation for thermal and pressure forces imposed on work string 30 during proppant slurry delivery that otherwise might shift perforations 78 relative to their directly facing perforations 80.

While the axial force used to maintain the alignment between the perforations 78 and 80 is preferably a tension force, it could alternatively be an axial compression force maintained on the portion of the work string 30 above locator 50. To use this alternate compression force it is simply necessary to reconfigure locator 50 so that it will pass upwardly through profile 40 but is releasably precluded from passing downwardly therethrough.

If desired, after the proppant slurry pumping step is completed, a cleanout step may be carried out to remove residual proppant slurry from the interior of nipple 38. After this optional clean out step is performed, the internal pressure within work string 30 is reduced so that locator 50 may be disengaged from profile 40 as will be discussed in detail below. Work string 30 is then pulled upwardly with a force sufficient to shear out and disable locator 50, thereby permitting locator 50 to pass upwardly through profile 40, and then further pulled upwardly until locator 58 engages profile 40 to halt further upward movement of work string 30. At this point, the annular upper and lower sliding side door end seals 62 and 64 sealingly engage the annular internal nipple sealing surface areas 42 and 46, respectively, with the screened tubular sliding side door structure 60 longitudinally extending between the sealing surfaces 42 and 46.

Finally, an upward pull is exerted on the portion of the work string 30 above locator 58 with sufficient force to separate work string assembly 48 at the releasable connection 70, thereby leaving the lower portion of the work string assembly 48 in place within nipple 38.

It should be noted that with the use of locator 50 to achieve the one trip method described above, the spent perforating gun 76 is automatically retrieved with the upper work string portion upon completion of the method instead of being simply dropped into the well's rat hole as is typically the case when a drop-off type perforating gun is used in conventional multi-trip perforation and stimulation methods.

Also, it should be noted that the screened sliding side door structure 60 was initially installed in its closed position in work string assembly 48. Accordingly, the sliding side door structure 60, when left in place within the nipple 38 at the end of the one-trip perforation and stimulation process, serves to isolate formation 14 from the balance of the well system by blocking inflow of production fluid from formation 14 through perforations 80 and then upwardly through either work string 30 or casing 34.

The overall method just described is thus utilized, in a single downhole trip, to sequentially carry out in a unique fashion a perforation function, a stimulation function and a subsequent production zone isolation function. As will be readily appreciated, similar one-trip methods may be subsequently performed on upwardly successive formations (not shown) to perforate, stimulate, and isolate them in readiness for later well fluid delivery therefrom.

After each formation has been readied for well fluid delivery in this manner, any zone, such as formation 14, may be selectively recommunicated with the interior of its associated work string section simply by running a conventional shifting tool down wellbore 32 and using it to downwardly shift the door portion of sliding side door structure 60, to thereby permit production fluid to flow from formation 14 inwardly through perforations 80, into the now opened screened sliding side door structure 60, and then upwardly through work string 30 to the surface. Alternatively, of course, the sliding side door structure could be rotationally shiftable between its open and closed positions instead of axially shiftable therebetween.

Even though FIGS. 1 and 2 depict a vertical well, it should be note by one skilled in the art that the selectively locking locator of the present invention is equally well-suited for deviated wells, inclined wells or horizontal wells. As such, it should be apparent to those skilled in the art that the use of directional terms such as above, below, upper, lower, upward, downward and the like are used in relation to the illustrative embodiments as they are depicted in the figures, the upward direction being towards the top of the corresponding figure and the downward direction being toward the bottom of the corresponding figure. It is to be understood that the selectively locking locator of the present invention may be operated in vertical, horizontal, inverted or inclined orientations without deviating from the principles of the present invention.

Figures 3A, 3B, 3C:
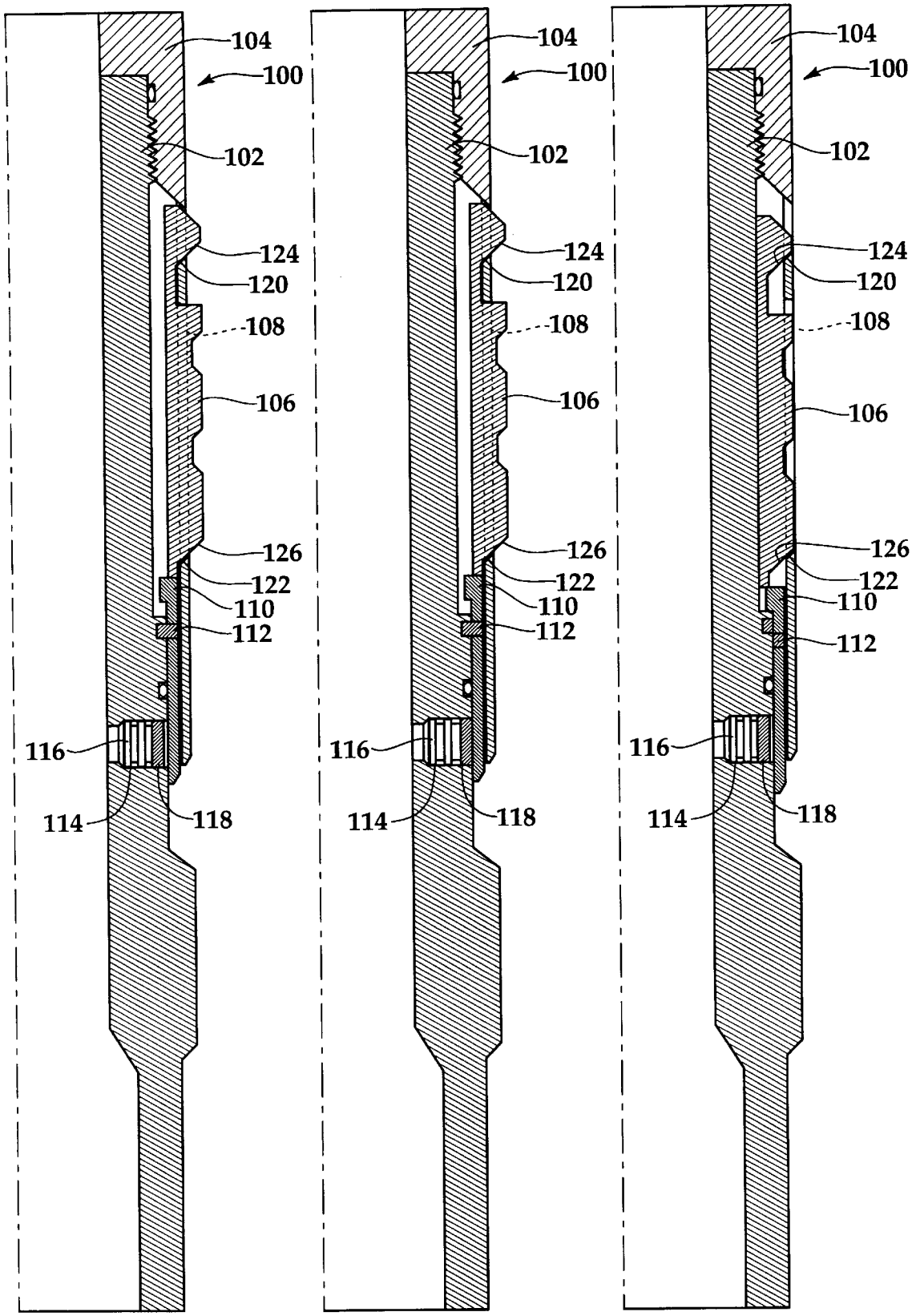
FIGS. 3A–3C are cross sectional views of a selectively locking locator device of the present invention in its various operating positions.

Referring now to FIGS. 3A–3C, therein is depicted a selectively locking locator of the present invention that is generally designated 100. Locator 100 includes a generally cylindrical axially extending mandrel 102. Securably and sealingly coupled to mandrel 102 is a housing 104. Housing 104 extends upwardly from mandrel 102 and is partially disposed exteriorily around mandrel 102 forming a receiving area for a locator key 106 such that locator key 106 is disposed between housing 104 and mandrel 102. Locator key 106 is radially extendable through a window 108 of housing 104. As best seen in FIG. 3A, locator key 106 has a first position wherein locator key 106 is engagable with a matching profile of a nipple such as profile 40 of FIG. 2. As best seen in FIG. 3C, locator key 106 has a second position wherein locator key 106 is retracted within the receiving area between mandrel 102 and housing 104 and away from profile 40.

Disposed between housing 104 and mandrel 102 is a support ring 110. One or more sheerable members 112 friably prevent support ring 110 from axial moving with respect to mandrel 102. As best seen in FIG. 3A, support ring 110 is positioned to prevent the movement of locator key 106 from the first position as long as sheerable members 112 are unsheered. As best seen in FIG. 3C, once sheerable members 112 are sheered in response to a predetermined axial force between support ring 110 and mandrel 102, support ring 110 is axially shifted with respect to mandrel 102 such that locator key 106 may be operated to the second position to disengage profile 40.

Mandrel 102 includes one or more radially bores 114. At least partially disposed within each radial bore 114 is an engagement mechanism such as piston 116 and engagement member 118. As explained in more detail below, each piston 116 may be integral with an engagement member 118 or each piston 116 and engagement member 118 may be separate parts. It should be noted by one skilled in the art that the relative size of each piston 116 and engagement member 118 will depend on such factors as the expected force to be supported by piston 116 and engagement member 118 of the engagement mechanism.

In the illustrated embodiment, piston 116 moves radially outwardly within radial bore 114 in response to internal pressure within mandrel 102. Piston 116 has an engagement member 118 operably extending therefrom. As best seen in FIG. 3A, engagement member 118 has a spaced apart relationship with support ring 110 when locator 100 is run into the wellbore. The spaced apart relationship between support ring 110 and engagement member 118 is maintained as locator 100 is passed downwardly through profile 40. Once locator 100 is returned upwardly into profile 40, locator key 106 is engaged with profile 40. As best seen in FIG. 3B, once an internal pressure is applied to mandrel 102, piston 116 along with engagement member 118 are outwardly radially shifted such that engagement member 118 contacts support ring 110. This internal pressure may be in the range of 50 to 200 psi or other suitable pressure depending on the size and number of pistons 116. When engagement member 118 contacts support ring 110, upward passage of locator 100 through profile 40 is disallowed.

As the pressure within the work string 30 is further elevated, the work string 30 is placed in tension which is supported by locator 100 without the possibility of sheering the sheerable members 112. This is achieved by transferring the axial force between support ring 110 and mandrel 102 to piston 116 through the contact between engagement member 118 and support ring 110. Thus, as long as the internal pressure is maintained within mandrel 102, piston 116 supports the axial load between support ring 110 and mandrel 102, sheerable members 112 remain unsheered, axial displacement of support ring 110 relative to mandrel 102 is prevented, retraction of locator key 106 from profile 40 is prevented and upward passage of locator 100 through profile 40 is disallowed.

When it is desired to remove locator 100 from profile 40, piston 116 is radially inwardly shifted to disengage engagement member 118 from support ring 110 by reducing the internal pressure within mandrel 102, by increasing the external pressure around housing 104 or both. As best seen in FIG. 3C, once piston 116 is radially inwardly shifted to disengage engagement member 118 from support ring 110, an upwardly acting tensioning force delivered to housing 104 and mandrel 102 is transmitted to support ring 110 via locator key 106 when locator key 106 is engaged with profile 40. When the tensioning force reached a predetermined level, the axial force between support ring 110 and mandrel 102, which is no longer carried by piston 116, sheers sheerable members 112, thereby allowing the axially displacement of support ring 110 relative to mandrel 102. For example, if there are ten sheerable members 112 each capable of carrying 5000 pounds extending between support ring 110 and mandrel 102, it would require 50,000 pounds of axial force to separate support ring 110 from mandrel 102. It should be noted that this sheer force is significantly less than the tension force during the perforation and stimulation steps described above. It should also be noted that this sheer force delivered to housing 104 radially inwardly biases locator key 106 due to the interaction between shoulders 120 and 122 of window 108 with surfaces 124 and 126 of locator key 106.

Figure 4A:
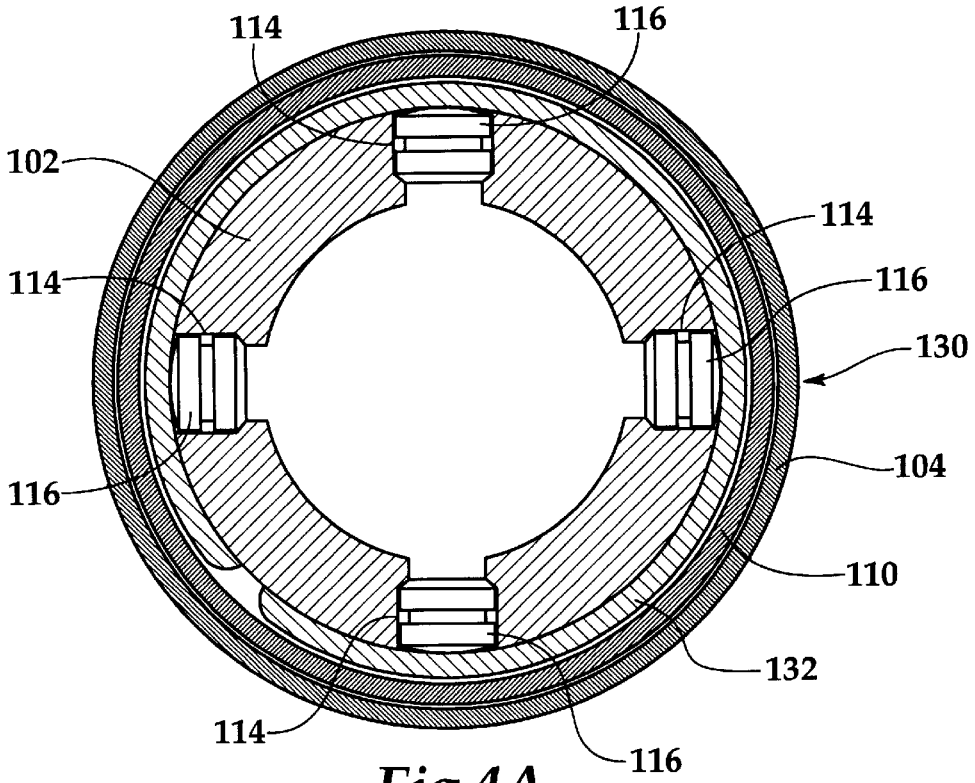
FIGS. 4A–4B are cross sectional views of a selectively locking locator device of the present invention.
Figure 4B:
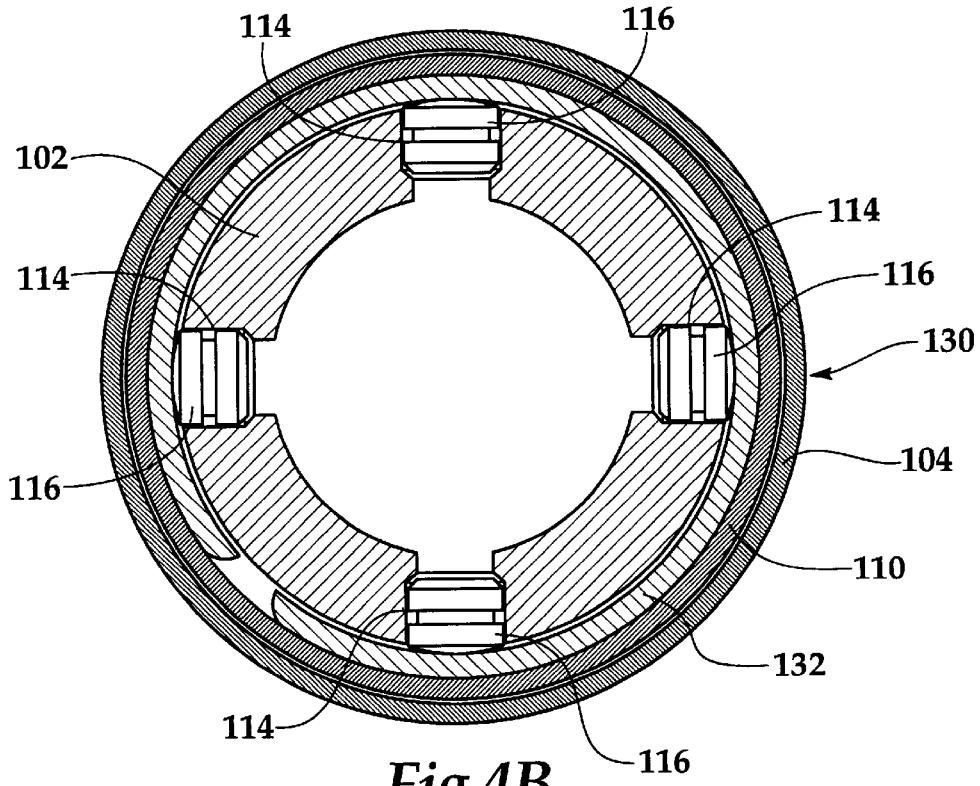

Referring now to FIGS. 4A–4B, therein are depicted cross sectional views of a selectively locking locator of the present invention in its various positions that is generally designated 130. Locator 130 includes mandrel 102 having four radial bores 114 each of which has a piston 116 disposed therein. Received around mandrel 102 and pistons 116 is a c-ring 132 that serves as engagement member 118 described above with reference to FIGS. 3A–3C. Dispose about c-ring 132 is support ring 110. Housing 104 encircles support ring 110.

When locator 130 is run into the wellbore and as best seen in FIG. 4A, c-ring 132 has a spaced apart relationship with support ring 110. The spaced apart relationship between support ring 110 and c-ring 132 is maintained as locator 130 is passed downwardly through the nipple profile. Once locator 130 is returned upwardly into the profile, the locator key engages the profile. As best seen in FIG. 4B, once an internal pressure is applied to mandrel 102, pistons 116 are outwardly radially shifted such that c-ring 132 is radially expanded to engage support ring 110. When c-ring 132 engages support ring 110, upward passage of locator 130 through the profile of the nipple profile is disallowed.

When it is desired to remove locator 130 from the nipple profile, the internal pressure within mandrel 102 is reduced below a predetermined level such that the spring action of c-ring 132 radially inwardly shifts pistons 116 within radial bores 114. C-ring 132 then disengages support ring 110, as best seen in FIG. 4A.

It should be noted that c-ring 132 may be free to rotate about mandrel 102 and pistons 116. Alternatively, the rotation of c-ring 132 relative to mandrel 102 may be prevented by, for example, a set screw. In this case, it is preferable the open portion of c-ring 132 not be aligned with one of the pistons 116.

Figure 5A:
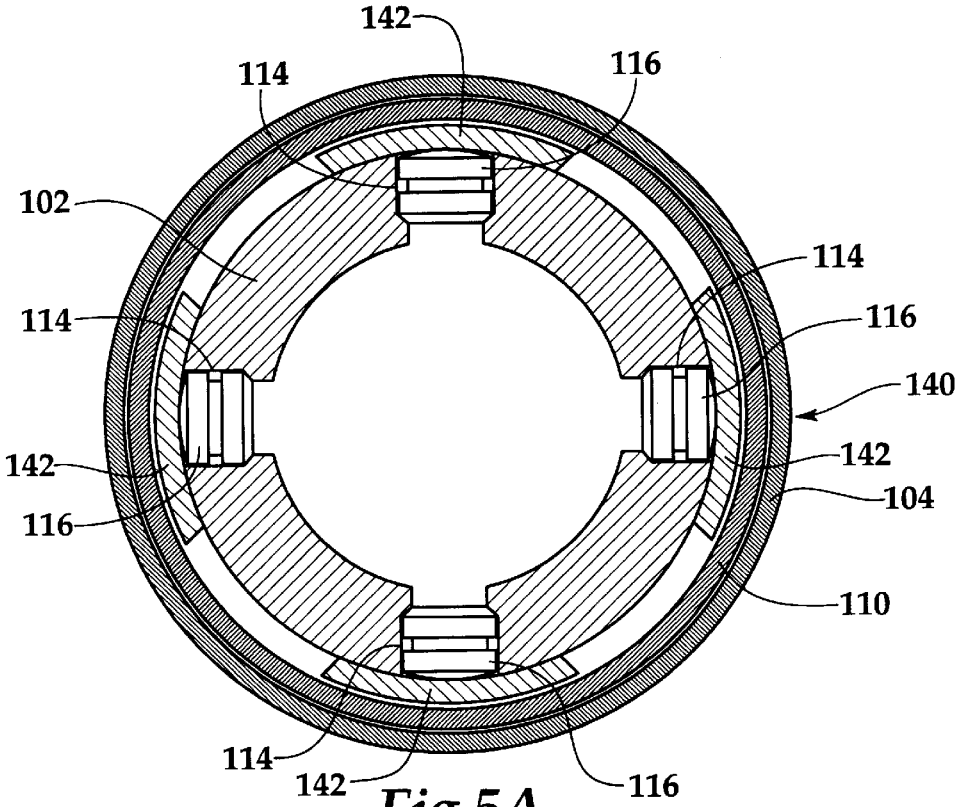
FIGS. 5A–5B are cross sectional views of a selectively locking locator device of the present invention.
Figure 5B:
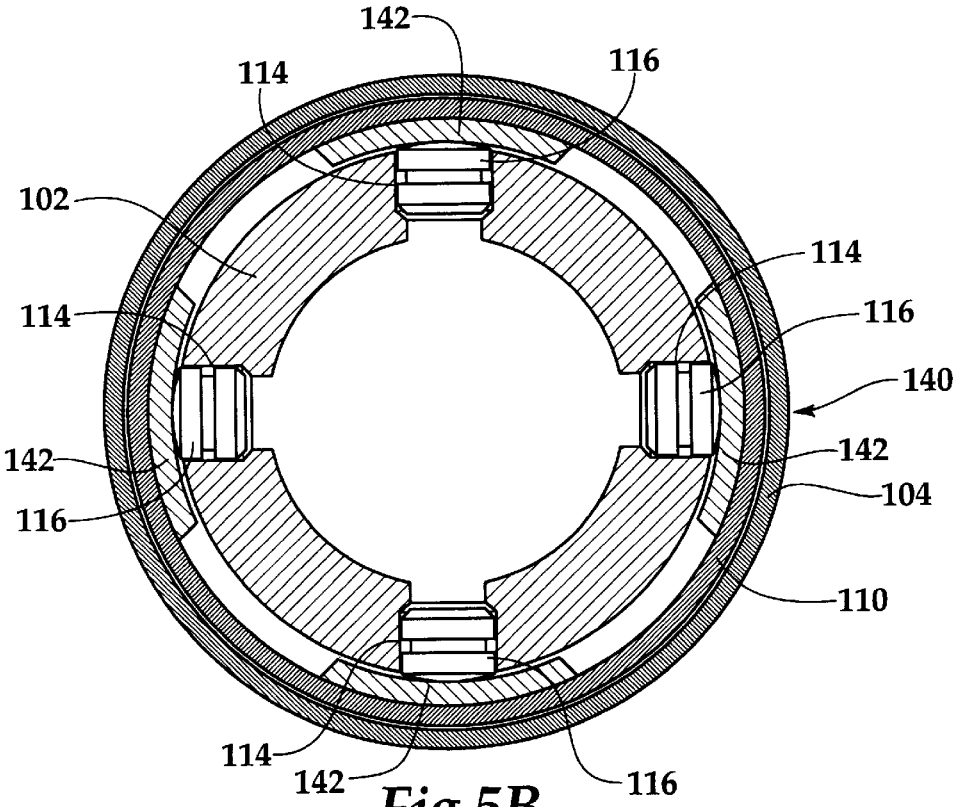

Referring now to FIGS. 5A–5B, therein are depicted cross sectional views of a selectively locking locator of the present invention in its various positions that is generally designated 140. Locator 140 includes mandrel 102 having four radial bores 114 each of which has a piston 116 disposed therein. Each of the pistons 116 has a piston extension 142 that is disposed about mandrel 142. The piston extensions 142 serve as engagement member 118 described above with reference to FIGS. 3A–3C. Dispose about piston extensions 142 is support ring 110. Housing 104 encircles support ring 110.

When locator 140 is run into the wellbore and as best seen in FIG. 5A, piston extensions 142 have a spaced apart relationship with support ring 110. The spaced apart relationship between support ring 110 and piston extensions 142 is maintained as locator 140 is passed downwardly through the nipple profile. Once locator 140 is returned upwardly into the profile, the locator key engages the profile. As best seen in FIG. 5B, once an internal pressure is applied to mandrel 102, pistons 116 are outwardly radially shifted such that piston extensions 142 are outwardly radially shifted to engage support ring 110. When piston extensions 142 engage support ring 110, upward passage of locator 140 through the nipple profile is disallowed.

When it is desired to remove locator 140 from the nipple profile, the internal pressure within mandrel 102 is reduced. In addition or alternatively, the external pressure around housing 104 is increased such that piston 116 and piston extensions 142 are radially inwardly shifted to disengage piston extensions 142 from support ring 110, as best seen in FIG. 5A.

Even though FIGS. 4A, 4B, 5A and 5B have been described with reference to four pistons 116, it should be noted by one skilled in the art that the exact number of pistons and the size of the pistons will depend on such factors as the diameter of the locator and the expected force that the pistons will operate under. As such, the exact number of pistons may be less than or greater than that describe above without departing from the principles of the present invention, such number including, but not limited to, one piston, two pistons, six pistons or eight pistons.

Figure 6A:
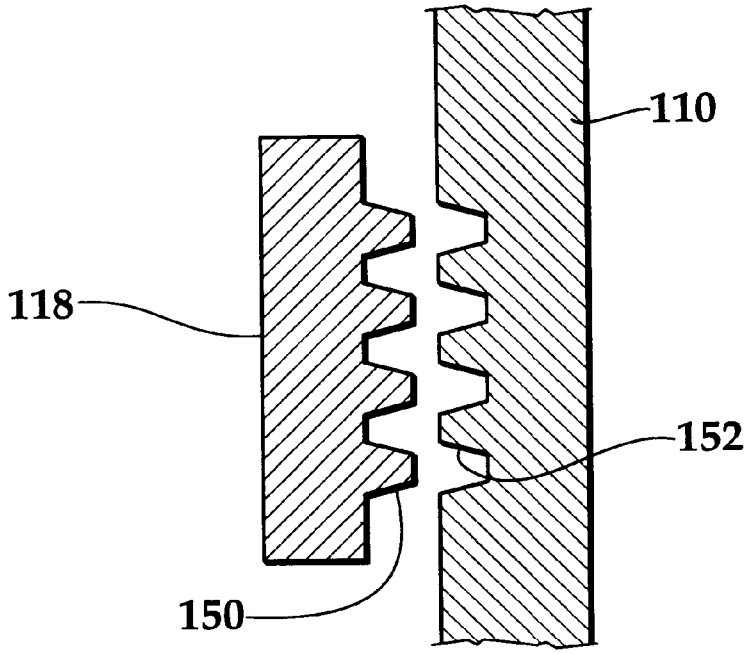
FIGS. 6A–6B are cross sectional views of the locking mechanism of two embodiments of a selectively locking locator device of the present invention.
Figure 6B:
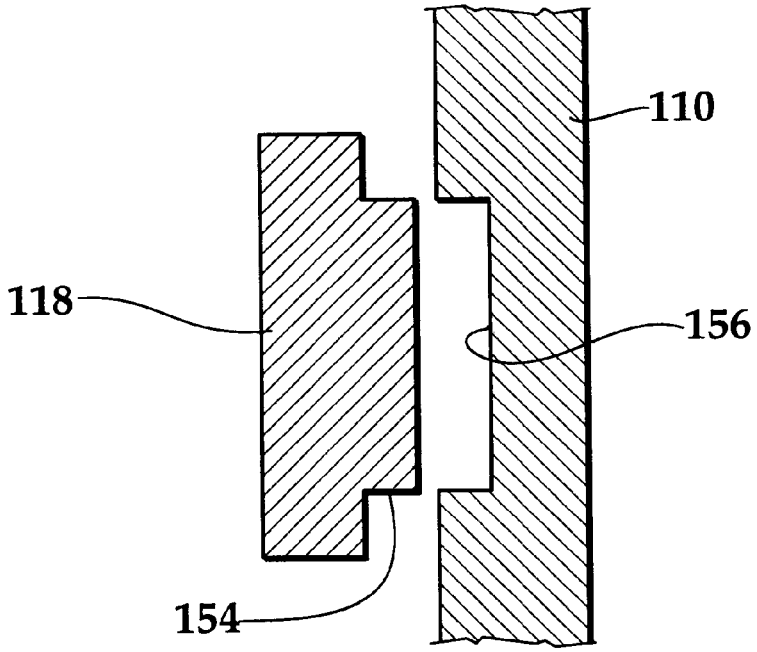

Referring next to FIGS. 6A–6B, the locking mechanisms of two embodiments of a selectively locking locator of the present invention are depicted in cross section. In FIG. 6A, engagement member 118 includes a plurality of gear teeth 150. Gear teeth 150 of engagement member 118 mesh with gear teeth 152 of support ring 110 when an internal pressure is applied to mandrel 102 that outwardly radially shifts pistons 116. When gear teeth 150 of engagement member 118 mesh with gear teeth 152 of support ring 110, upward passage of the locator through the nipple profile is disallowed. Similarly, as depicted in FIG. 6B, engagement member 118 may alternatively include one or more projections 154. Projections 154 of engagement member 118 are inserted into a corresponding number of slots 156 of support ring 110 when an internal pressure is applied to mandrel 102 that outwardly radially shifts pistons 116. When projections 154 of engagement member 118 are inserted into slots 156 of support ring 110, upward passage of the locator through the nipple profile is disallowed.

Even though the present invention has been describe with reference to a selectively locking locator, it is to be understood by those skilled in the art that the present invention is broadly applicable to a variety of downhole tools when it is desirable to selective prevent the axial movement of two tubular members relative to one another. For example, one of the tubular member, the interior or exterior member, has a radial bore in the sidewall thereof wherein a piston is disposed. The piston selectively engages the other tubular member in response to a differential pressure between the interior and the exterior of the tubular members. As such, axial movement of the tubular members relative to one another is selectively prevented while the piston is engaged.

Figure 7A:
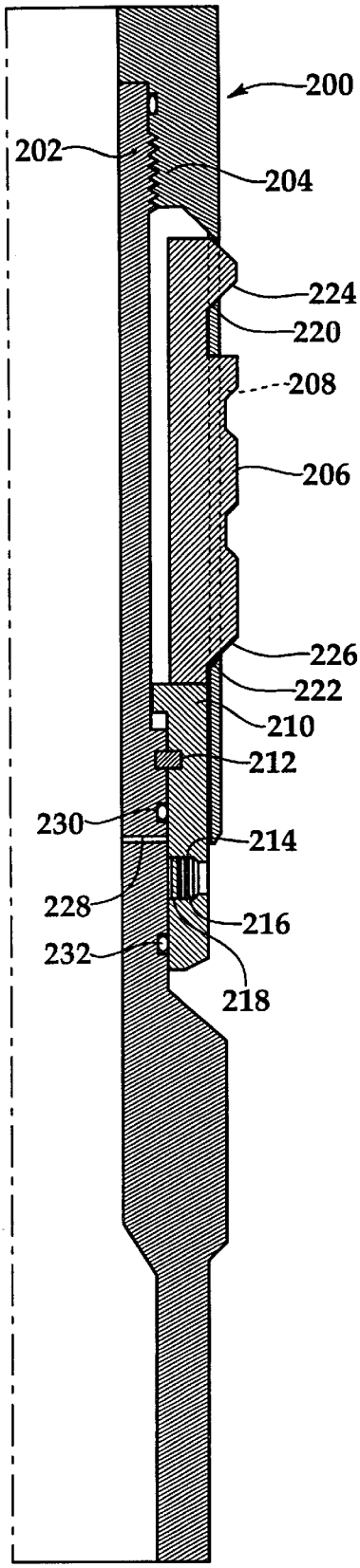
FIGS. 7A–7C are cross sectional views of a selectively locking locator device of the present invention in its various operating positions.
Figure 7B:
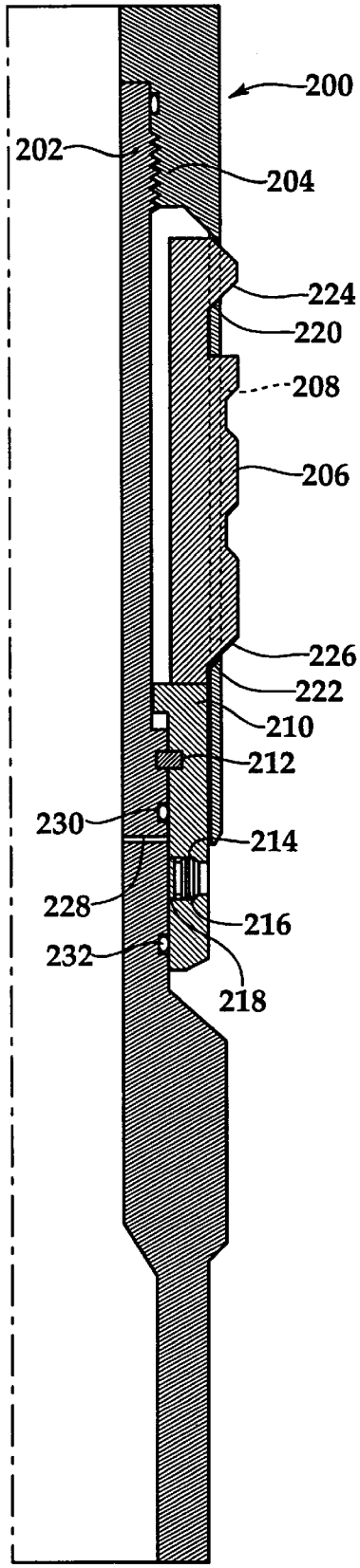
Figure 7C:
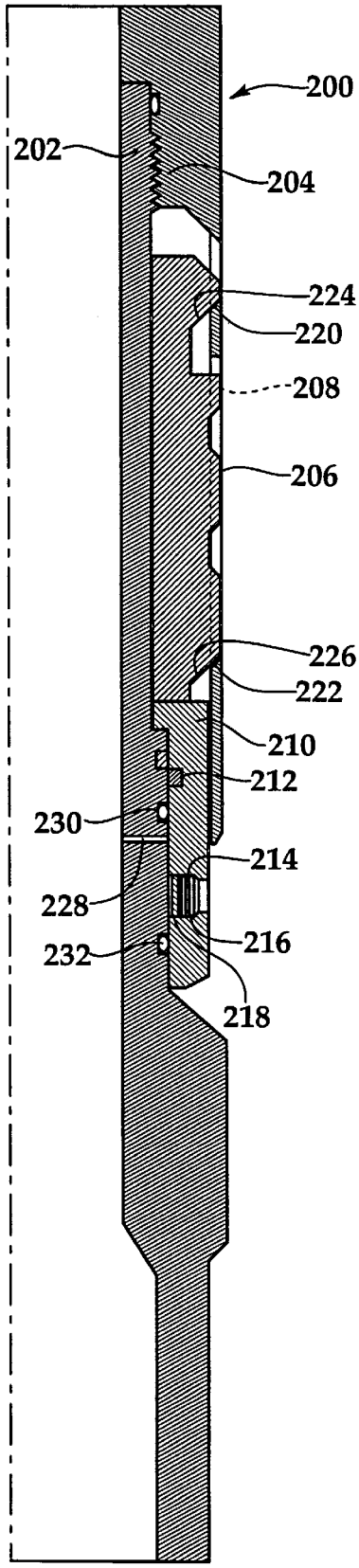

Referring now to FIGS. 7A–7C, therein is depicted another embodiment of a selectively locking locator of the present invention that is generally designated 200. Locator 200 includes a generally cylindrical axially extending mandrel 202. Securably and sealingly coupled to mandrel 202 is a housing 204. Housing 204 extends upwardly from mandrel 202 and is partially disposed exteriorily around mandrel 202 forming a receiving area for a locator key 206 such that locator key 206 is disposed between housing 204 and mandrel 202. Locator key 206 is radially extendable through a window 208 of housing 204. As best seen in FIG. 7A, locator key 206 has a first position wherein locator key 206 is engagable with a matching profile of a nipple such as profile 40 of FIG. 2. As best seen in FIG. 7C, locator key 206 has a second position wherein locator key 206 is retracted within the receiving area between mandrel 202 and housing 204 and away from profile 40.

Disposed between housing 204 and mandrel 202 is a support ring 210. One or more sheerable members 212 friably prevent support ring 210 from axial moving with respect to mandrel 202. As best seen in FIG. 7A, support ring 210 is positioned to prevent the movement of locator key 206 from the first position as long as sheerable members 212 are unsheered. As best seen in FIG. 7C, once sheerable members 212 are sheered in response to a predetermined axial force between support ring 210 and mandrel 202, support ring 210 is axially shifted with respect to mandrel 202 such that locator key 206 may be operated to the second position to disengage profile 40.

Support ring 210 includes one or more radially bores 214. At least partially disposed within each radial bore 214 is an engagement mechanism such as piston 216 and engagement member 218. As explained above, each piston 216 may be integral with an engagement member 218 or each piston 216 and engagement member 218 may be separate parts. It should be noted by one skilled in the art that the relative size of each piston 216 and engagement member 218 will depend on such factors as the expected force to be supported by piston 216 and engagement member 218 of the engagement mechanism.

In the illustrated embodiment, piston 216 moves radially inwardly within radial bore 214 in response to external pressure around support ring 210. As best seen in FIG. 7A, engagement member 218 has a spaced apart relationship with support ring 210 when locator 200 is run into the wellbore. The spaced apart relationship between support ring 210 and engagement member 218 is maintained as locator 200 is passed downwardly through profile 40. Once locator 200 is returned upwardly into profile 40, locator key 206 is engaged with profile 40. As best seen in FIG. 7B, once an external pressure is applied to support ring 210, piston 216 along with engagement member 218 are inwardly radially shifted such that engagement member 218 contacts mandrel 202. This external pressure may be in the range of 50 to 200 psi or other suitable pressure depending on the size and number of pistons 216. When engagement member 218 contacts mandrel 202, upward passage of locator 200 through profile 40 is disallowed.

As the pressure within the work string 30 is further elevated, the work string 30 is placed in tension which is supported by locator 200 without the possibility of sheering the sheerable members 212. This is achieved by transferring the axial force between support ring 210 and mandrel 202 to piston 216 through the contact between engagement member 218 and mandrel 202. Thus, as long as the external pressure is maintained around support ring 210, piston 216 supports the axial load between support ring 210 and mandrel 202, sheerable members 212 remain unsheered, axial displacement of support ring 210 relative to mandrel 202 is prevented, retraction of locator key 206 from profile 40 is prevented and upward passage of locator 200 through profile 40 is disallowed.

When it is desired to remove locator 200 from profile 40, piston 216 is radially outwardly shifted to disengage engagement member 218 from mandrel 202 by reducing the external pressure around support ring 210, by increasing the internal pressure within mandrel 202 which is transmitted via port 228 to engagement member 218 between seals 230, 232 or both. In addition, if engagement member 218 includes a c-ring as describe above, the spring force of the c-ring assists in the outward movement of piston 216 by outwardly radially biasing piston 216. As best seen in FIG. 7C, once piston 216 is radially outwardly shifted to disengage engagement member 218 from mandrel 202, an upwardly acting tensioning force delivered to housing 204 and mandrel 202 is transmitted to support ring 210 via locator key 206 when locator key 206 is engaged with profile 40. When the tensioning force reached a predetermined level, the axial force between support ring 210 and mandrel 202, which is no longer carried by piston 206, sheers sheerable members 212, thereby allowing the axially displacement of support ring 210 relative to mandrel 202. It should be noted that this sheer force is significantly less than the tension force during the perforation and stimulation steps described above. It should also be noted that this sheer force delivered to housing 204 radially inwardly biases locator key 206 due to the interaction between shoulders 220 and 222 of window 208 with surfaces 224 and 226 of locator key 206.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A downhole tool comprising:

a first tubular member;

a second tubular member slidably disposed relative to the first tubular member, the second tubular member having a radial bore in the sidewall thereof; and an engagement mechanism at least partially disposed within the radial bore and including a c-ring, the engagement mechanism selectively engagable with the first tubular member in response to a first differential pressure between the interior and the exterior of the second tubular member, thereby selectively preventing axial displacement of the first tubular member relative to the second tubular member.

2. The downhole tool as recited in claim 1 wherein the second tubular member is disposed within the interior of the first tubular member.

3. The downhole tool as recited in claim 2 wherein the engagement mechanism is shifted radially outwardly in response to the first differential pressure between the interior and the exterior of the second tubular member.

4. The downhole tool as recited in claim 1 wherein the second tubular member is disposed exteriorily about the first tubular member.

5. The downhole tool as recited in claim 4 wherein the engagement mechanism is shifted radially inwardly in response to the first differential pressure between the interior and the exterior of the second tubular member.

6. The downhole tool as recited in claim 1 wherein the c-ring radially inwardly biases the engagement mechanism to disengage the engagement mechanism from the first tubular member.

7. The downhole tool as recited in claim 1 wherein the c-ring radially outwardly biases the engagement mechanism to disengage the engagement mechanism from the first tubular member.

8. The downhole tool as recited in claim 1 wherein the engagement mechanism is disengaged from the first tubular member in response to a second differential pressure having a gradient opposite to that of the first differential pressure.

9. The downhole tool as recited in claim 8, wherein the second differential pressure radially inwardly shifts the engagement mechanism to disengage the engagement mechanism from the first tubular member.

10. The downhole tool as recited in claim 8 wherein the second differential pressure radially outwardly shifts the engagement mechanism to disengage the engagement mechanism from the first tubular member.

11. A downhole tool comprising:

a locator key disposed between a housing and a mandrel and radially extendable through a window of the housing between an engagable position and a retracted position;

a support ring disposed between the housing and the mandrel, the support ring preventing movement of the locator key from the engagable position to the retracted position until the support ring is axially displaced relative to the mandrel; and an engagement mechanism at least partially disposed within a radial bore of the mandrel and including a c-ring, the engagement mechanism selectively engagable with the support ring in response to a first differential pressure between the interior and exterior of the mandrel, thereby selectively preventing axial displacement of the support ring relative to the mandrel and selectively preventing movement of the locator key to the retracted position.

12. The downhole tool as recited in claim 11 further comprising a sheerable member extending between the mandrel and the support ring that sheers in response to a predetermined axial force between the support ring and the mandrel.

13. The downhole tool as recited in claim 11 wherein the c-ring radially biases the engagement mechanism to disengage the support ring when the first differential pressure is reduced below a predetermined level.

14. The downhole tool as recited in claim 11 wherein a second differential pressure having a gradient opposite of the first differential pressure acts on the engagement mechanism to disengage the engagement mechanism from the support ring.

15. The downhole tool as recited in claim 11 wherein the engagement mechanism includes a plurality of teeth and the support ring includes a plurality of teeth, the plurality of teeth of the engagement mechanism engaging the plurality of teeth of the support ring to selectively prevent axial displacement of the support ring relative to the mandrel when the first differential pressure is acting on the engagement mechanism.

16. The downhole tool as recited in claim 11 wherein the engagement mechanism includes a projection and the support ring includes a slot, the projection of the engagement mechanism engaging the slot of the support ring to selectively prevent axial displacement of the support ring relative to the mandrel when the first differential pressure is acting on the engagement mechanism.

17. A method for selectively preventing relative axial movement between a first tubular member and a second tubular member slidably disposed relative to the first tubular member in a downhole tool, the method comprising the steps of:

disposing an engagement mechanism at least partially within a radial bore of the second tubular member, the engagement mechanism including a c-ring;

applying a first differential pressure between the interior and the exterior of the second tubular member; and selectively engaging the engagement mechanism with the first tubular member in response to the first differential pressure, thereby selectively preventing axial displacement of the first tubular member relative to the second tubular member.

18. The method as recited in claim 17 further comprising the step of disposing the second tubular member within the interior of the first tubular member.

19. The method as recited in claim 18 wherein the step of selectively engaging the engagement mechanism with the first tubular member further comprises shifting the engagement mechanism radially outwardly in response to the first differential pressure between the interior and the exterior of the second tubular member.

20. The method as recited in claim 17 further comprising the step of disposing the second tubular member exteriorily about the first tubular member.

21. The method as recited in claim 20 wherein the step of selectively engaging the engagement mechanism with the first tubular member further comprises shifting the engagement mechanism radially inwardly in response to the first differential pressure between the interior and the exterior of the second tubular member.

22. The method as recited in claim 17 further comprising the step of radially inwardly biasing the c-ring to disengage the engagement mechanism from the first tubular member.

23. The method as recited in claim 17 further comprising the step of radially outwardly biasing the c-ring to disengage the engagement mechanism from the first tubular member.

24. The method as recited in claim 17 further comprising the step of applying a second differential pressure having a gradient opposite to that of the first differential pressure between the interior and exterior of the second tubular member to disengage the engagement mechanism from the first tubular member.

25. The method as recited in claim 24 further comprising the step of radially inwardly shifting the engagement mechanism to disengage the engagement mechanism from the first tubular member in response to the second differential pressure.

26. The method as recited in claim 24 further comprising the step of radially outwardly shifting the engagement mechanism to disengage the engagement mechanism from the first tubular member in response to the second differential pressure.

27. A method for selectively preventing passage of a locator device through a nipple profile within a wellbore comprising the steps of:

engaging a locator key of the locator device with the nipple profile;

providing a first differential pressure to the locator device to act on an engagement mechanism at least partially disposed within a radial bore in the sidewall of a mandrel and including a c-ring; and radially shifting the engagement mechanism to engage a support ring and prevent axial displacement of the support ring relative to the mandrel, thereby preventing retraction of the locator key from the nipple profile and preventing passage of the locator device through the nipple profile in a first direction.

28. The method as recited in claim 27 further comprising the step of extending a sheerable member between the support ring and the mandrel that sheers in response to a predetermined axial force between the support ring and the mandrel.

29. The method as recited in claim 27 further comprising the steps of reducing the first differential pressure below a predetermined level and radially biasing the engagement mechanism with the c-ring to disengage the engagement mechanism from the support ring.

30. The method as recited in claim 27 further comprising the step of disposing a engagement mechanism extension between the engagement mechanism and the support ring.

31. The method as recited in claim 27 further comprising the step of engaging a plurality of teeth on the engagement mechanism with a plurality of teeth on the support ring to selectively prevent axial displacement of the support ring relative to the mandrel.

32. The method as recited in claim 27 further comprising the step of engaging a projection on the engagement mechanism with a slot in the support ring to selectively prevent axial displacement of the support ring relative to the mandrel.

33. The method as recited in claim 27 further comprising the steps of applying a second different pressure having a gradient opposite of that of the first differential pressure to the locator device and radially shifting the engagement mechanism to disengage the engagement mechanism from the support ring.

* * * * *